United States Patent [19]

Hisatsune et al.

[11] Patent Number: 4,459,445

[45] Date of Patent: Jul. 10, 1984

[54] CIRCUIT BREAKER

[75] Inventors: Fumiyuki Hisatsune; Shinji Yamagata; Junichi Terachi; Kiyomi Yamamoto, all of Fukuyama; Hajimu Yoshiyasu, Itami, all of Japan

[73] Assignee: Mitsubishi Denki Kabushiki Kaisha, Tokyo, Japan

[21] Appl. No.: 351,928

[22] Filed: Feb. 24, 1982

[30] Foreign Application Priority Data

Mar. 2, 1981 [JP] Japan ..... 56-30945
Mar. 2, 1981 [JP] Japan ..... 56-30946
Mar. 2, 1981 [JP] Japan ..... 56-30947

[51] Int. Cl.[3] ..... H01H 33/02; H01H 33/12

[52] U.S. Cl. ..... 200/144 R; 200/146 R; 200/304

[58] Field of Search ..... 200/144 R, 304, 146 R

[56] References Cited

U.S. PATENT DOCUMENTS 537,130 4/1895 Sperry ..... 200/304
3,402,273 9/1968 Davis ..... 200/144 R
3,599,130 8/1971 Murai ..... 335/43
3,749,867 7/1973 Rexroad ..... 200/144 R

FOREIGN PATENT DOCUMENTS 1765051 7/1971 Fed. Rep. of Germany ... 200/144 R

*Primary Examiner*—Robert S. Macon
*Attorney, Agent, or Firm*—Wenderoth, Lind & Ponack

[57] ABSTRACT

A circuit breaker in which arc shielding members are provided for predetermined contacts among a plurality of contact pairs arrayed in parallel, so that the arc will take place between predetermined contacts when the contacts are opened. The arc shielding members are made of a material having resistivity greater than that of the conductors to which the contacts are attached. The arc shielding members work to effectively inject metallic particles of contact material into the arc, so that the arcing voltage is rapidly raised and so that feet of the arc will not spread to the conductors in the vicinities of the contacts.

8 Claims, 15 Drawing Figures

CIRCUIT BREAKER

BACKGROUND OF THE INVENTION

The present invention relates to a circuit breaker. More specifically, the invention provides a novel circuit breaker in which shielding members are selectively provided for the contacts, and the arcing voltage established across the contacts is quickly raised by the arc shielding members in order to effectively extinguish the arc.

In the conventional circuit breakers, the arc established across the contacts has tended to spread to conductors in the vicinities of the contacts, and it has not been possible to sufficiently increase the arcing voltage. Moreover, it has not been possible to establish the arc across desired contacts.

SUMMARY OF THE INVENTION

The object of the present invention is to enhance the circuit breaking performance of the circuit breaker. This object of the invention is accomplished by a circuit breaker in which the arc is established across desired contacts, arc shielding members are provided which surround the contacts, and particles of contact material are effectively injected by the arc shielding members into the arc that is established across the contacts, so that the feet of arc will not spread to the conductors in the vicinities of the contacts.

BRIEF DESCRIPTION OF THE DRAWINGS

In the drawings, the same reference numerals denote the same or corresponding portions.

DESCRIPTION OF THE PREFERRED EMBODIMENTS

Figure 1A:
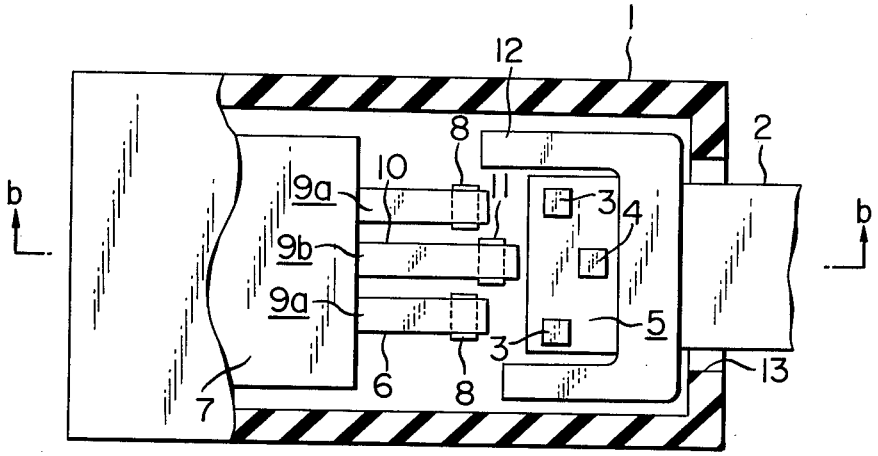
FIG. 1*a* is a sectional plan view of a conventional circuit breaker to which the present invention can be adapted.

A conventional circuit breaker to which the present invention can be adapted will be described below with reference to FIGS. 1*a* and 1*b*. The circuit breaker comprises an enclosure 1 made of an insulating material, a fixed conductor 2 one end of which is connected to the power-supply side and which extends through a lower portion of the enclosure 1, a pair of fixed main contacts 3 attached to the upper surface of the fixed conductor 2, and a fixed arching contact 4 which is located midway between the fixed main contacts 3 on the upper surface of the fixed conductor 2. The fixed conductor 2 and contacts 3 and 4 constitute a fixed contactor 5.

A pair of movable main conductors 6 are attached to an operating mechanism 7 and are actuated by the operating mechanism 7 in response to an excess current. Movable main contacts 8 are attached to the lower free ends of the movable main conductors 6. The movable main conductors 6 and the movable main contacts 8 constitute movable main contactors 9*a* which are opposed to the fixed contactor 5, thereby to constitute two contactor pairs 9*a*, 5 for carrying current.

There is further provided a movable arcing conductor 10 which is located between the two movable main conductors 6, and which is connected to the operating mechanism 7. The movable arcing conductor 10 is also actuated by the operating mechanism 7. A movable arcing contact 11 is attached to the free lower surface of the movable arcing conductor 10. The movable arcing conductor 10 and the movable arcing contact 11 constitute a movable arcing contactor 9*b* which is opposed to the fixed arcing contact 4, thereby to constitute an arcing contact pair 4, 11 for treating the arc that develops when the contacts are opened. There are further provided arc extinguishing plates 12 for quenching the arc that develops between the movable arcing contact 11 and the fixed arcing contact 4 when the movable arcing contact 11 is opened, and an outlet port 13 through which the arc or hot gas produced in the enclosure 1 can escape.

In the thus constructed circuit breaker, if now the movable main contacts 8 and the fixed main contacts 3 are in contact, i.e., if the main contact pairs for carrying current are closed, the electric power is supplied from the power supply side to the load side via the fixed conductor 2, fixed main contacts 3, movable main contacts 8, and movable main conductors 6. Under this condition, if a heavy current such as short-circuit current flows through the closed circuit, the operating mechanism 7 acts to turn the movable main conductors 6 and the movable arcing conductor 10 around their ends as fulcrums, whereby the movable main contacts 8 and the movable arcing contact 11 are separated from the fixed main contacts 3 and the fixed arcing contact 4.

In this case, the circuit breaker has been so constructed that the pair of arcing contacts 4, 11 are opened arc opened at a time which lags the opening of the pairs of main contacts 3, 8. Therefore, the arc A develops between the fixed arcing contact 4 and the movable arcing contact 11 only, and an arcing voltage is generated between the fixed arcing contact 4 and the movable arcing contact 11. The arcing voltage increases depending upon the distance which the movable arcing contact 11 is separated from the fixed arcing contact 4. At the same time, the arc A is attracted by magnetic force toward the arc extinguishing plates 12. Consequently, the arcing voltage is further raised. The arc A is extinguished at the moment when the arc current reaches a zero point; the circuit breaking is finished.

During the operation of breaking, a large amount of energy is generated between the movable arcing contact 11 and the fixed arcing contact 4 by the arc 8 within short periods of time, i.e., within several milliseconds. Accordingly, the temperature of the gas in the enclosure 1 rises, and the pressure abruptly increases. The high temperature and high pressure gas, however, is released into the open air through the outlet port 13.

The circuit breaker which performs the circuit breaking operation as described above, should have a high arcing voltage. That is, high arcing voltage restrains the arc current that flows during the circuit breaking operation, and reduces the current that flows through the circuit breaker. Therefore, a circuit breaker which generates high arcing voltage has good performance characteristics for protecting various electric machines and equipment inclusive of including the wiring with which the circuit breaker is connected in series. In circuits which include a plurality of circuit breakers connected in series, furthermore, the region of selective or cooperative circuit breaking or the region of simultaneous circuit breaking can be expanded.

In the conventional circuit breakers of this type, therefore, the movable main contactors **9*a* and the movable arcing contactor 9*b*** have been operated to separate the contact pairs at high speeds in order to achieve a high arcing voltage, or the arc A has been stretched by utilizing the magnetic force of the arc extinguishing plates. However, limitations exist on the arcing voltage, and satisfactory performance for limiting the current has not been obtained.

The arcing voltage across the fixed contact and the movable contact will be explained below prior to illustrating the circuit breaker of the present invention.

In general, the arc resistance is according to the following relation:

$$R=\rho l/S$$

where R denotes arc resistance (Ω), $\rho$ denotes arc resistivity (Ω.cm), l denotes arc length (cm), and S denotes the sectional area of arc ($cm^2$).

In the arc having a current of several kiloamperes and a length shorter than 50 mm, however, the arcing space is occupied by the particles of contact material emitted from the contacts. The particles of contact material are emitted in a direction at right angles to the surface of contacts. Further, the particles when emitted are heated to nearly the boiling point of the contact material. Moreover, as soon as they are injected into the arcing space, the particles receive electrical energy, are placed in high-temperature and high-pressure conditions, become electrically conductive, and flow away from the contact at high speeds while diverging in accordance with the pressure distribution in the arcing space. Thus, the arc resistivity $\rho$ and the sectional area S of arc in the arcing space determined by the quantity of particles of contact material and by the direction of emission. Therefore, the arcing voltage is also determined by the behavior of the particles of contact material.

The behavior of the particles of electrode material will be explained below with reference to the conventional circuit breaker shown in FIG. 2. As mentioned already, the arc A in the circuit breaker of FIGS. **1*a* and 1*b* takes place between the fixed arcing contact 4 and the movable arcing contact 11 only. Therefore, FIG. 2 illustrates this pair of arcing contacts only, and the same reference numerals as those of FIGS. 1*a* and 1*b* denote the same portions, A denotes the arc, planes X denote opposing surfaces on which the contacts 4 and 11 will come into contact with each other, and planes Y denote portions of contact surfaces and conductor surfaces which establish electrically contacting surfaces in addition to the opposing surfaces X. Further, dot-dash chain lines Z1 denote contours of arc A, and symbols a, b and c schematically represent particles of contact material emitted from the contacts 4 and 11**, wherein a denotes particles emitted from the central portions of the opposing surfaces X, b denotes particles of contact material emitted from the surfaces Y, and c denotes particles of contact material emitted from the periphery of the opposing surfaces X midway between the regions from where the particles a and b were emitted. After being emitted, the particles flow as indicated by arrows m, n, and O1.

Particles a, b and c of contact material emitted from the contacts 4 and 11 are heated to the boiling point of the contact material, i.e., heated to about 3,000° C. up to a temperature at which they become electrically conductive, i.e., at 8,000° C. or further up to about 20,000° C. Consequently, the particles absorb the energy from the arcing space; i.e., the temperature in the arcing space decreases, and arc resistance increases. Here, the amount of energy which the particles a, b and c absorb from the arcing space is determined by the positions and paths of emission of the particles a, b and c that are emitted from the contacts 4 and 11, and the degree of temperature rise is determined by the amount of energy absorbed.

In the conventional circuit breaker as will be obvious from FIG. 2, therefore, the particles a of contact material emitted from the central portions of the opposing surfaces X absorb large amounts of energy from the arcing space. However, the particles b emitted from portions Y of the contact surfaces and the conductor surfaces absorb energy from the arcing space in amounts less than the amounts absorbed by the particles a. Further, the particles c emitted from the periphery of the opposing surfaces X absorb energy in amounts midway between those absorbed by the particles a and b. In other words, large amounts of energy are absorbed in the region where the particles a flow, and the temperature in the arcing space is decreased and, hence, the arc resistivity $\rho$ is increased. In the regions where particles b and c flow, however, the energy is not absorbed in large amounts. Therefore, the temperature in the arcing space is decreased less, and the arc resistivity $\rho$ increases little. Moreover, since arc A develops from the opposing surfaces X and from the contact surfaces Y, the sectional area of the arc increases, and the arc resistance decreases.

The flow of energy from the arcing space to the particles a, b and c of contact marterial corresponds to the electrical energy injected into the arcing space. Therefore, if increased amounts of the particles b and c of contact material are injected into the arcing space, the temperature in the arcing space can inevitably be reduced greatly, whereby the arc resistivity $\rho$ can be increased to greatly increase the arcing voltage.

Figure 3A:
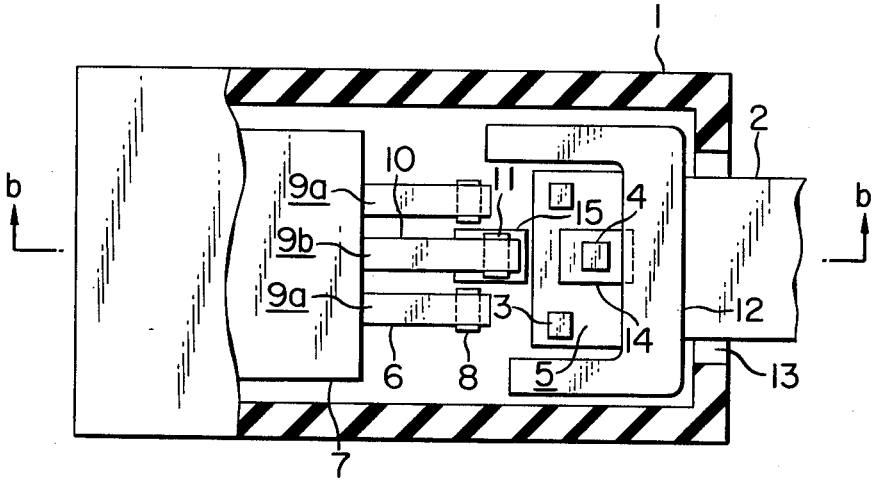
FIG. 3*a* is a sectional plan view of a circuit breaker according to an embodiment of the present invention.
Figure 3B:
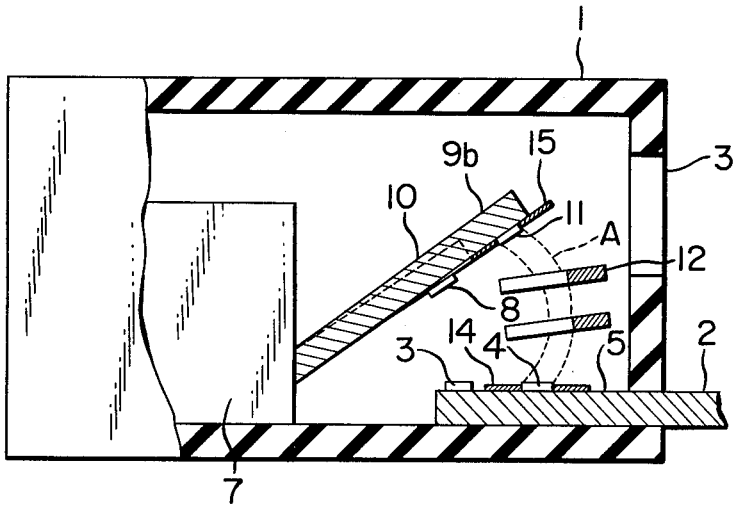
FIG. 3*b* is a sectional side view of the circuit breaker taken along the line b—b of FIG. 3*a;*
Figure 4A:
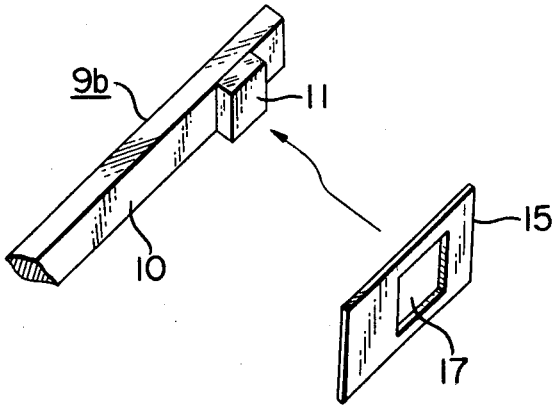
FIG. 4*a* is a perspective view of an arc shielding member which is used for a movable contactor contact of the embodiment of FIG. 3*a;*
Figure 4B:
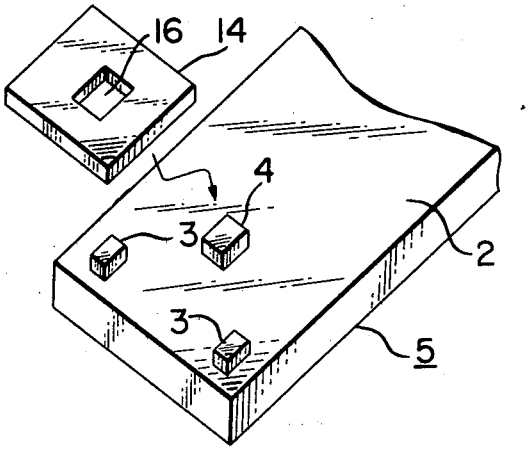
FIG. 4*b* is a perspective view of an arc shielding member which is used for a fixed contactor contact of the embodiment of FIG. 3*a;*

Therefore, the object of the present invention is to provide a circuit breaker having good current-limiting performance, by causing particles of contact material generated across the contacts to be injected into the arcing space in increased amounts, so that the arcing voltage is strikingly increased. FIGS. 3*a* and 3*b* illustrate an embodiment of the present invention, in which the portions corresponding to those of FIGS. 1*a* and 1*b* are denoted by the same reference numerals. In this embodiment of the present invention, the pair of arcing contacts 4 and 11 are provided with arc shielding members 14 and 15 which are composed of flat plates having holes 16, 17 into which the contacts 4 and 11 fit, as shown in FIGS. 4*a* and 4*b*. The arc shielding members 14 and 15 are placed on the conductors 10 and 2 so as to surround the peripheries of the contacts 4 and 11. The arc shielding members are made of a material having resistivity greater than that of the conductors 10 and 2. Examples of the high-resistance material include organic or inorganic electrical insulating materials, ceramics, nichrome, nickel, iron, copper-nickel, copper-manganese, copper-manganin, iron-carbon, iron-nickel and iron-chromium.

The arc shielding members 14 and 15 in the form of plates can be fastened to the corresponding conductors 2 and 10. Or, the arc shielding members can be formed by coating the fixed conductor 2 and the movable arcing conductor 10 with a high-resistance material such as ceramic material by plasma-jet melt injection, so as to cover the periphery of the fixed arcing contact 4 and the movable arcing contact 11. The latter method makes it possible to cheaply and easily form the arc shielding members. In particular, the weight is not increased and the moment of inertia of the movable arcing contactor 9*b*. Therefore, the movable arcing contactor 9*b* remains small can be opened at high speeds to achieve increased arcing voltage. In the embodiment of the present invention, the arc shielding members are in the shape of plates in order to squeeze the arc as will be described later.

Figure 5:
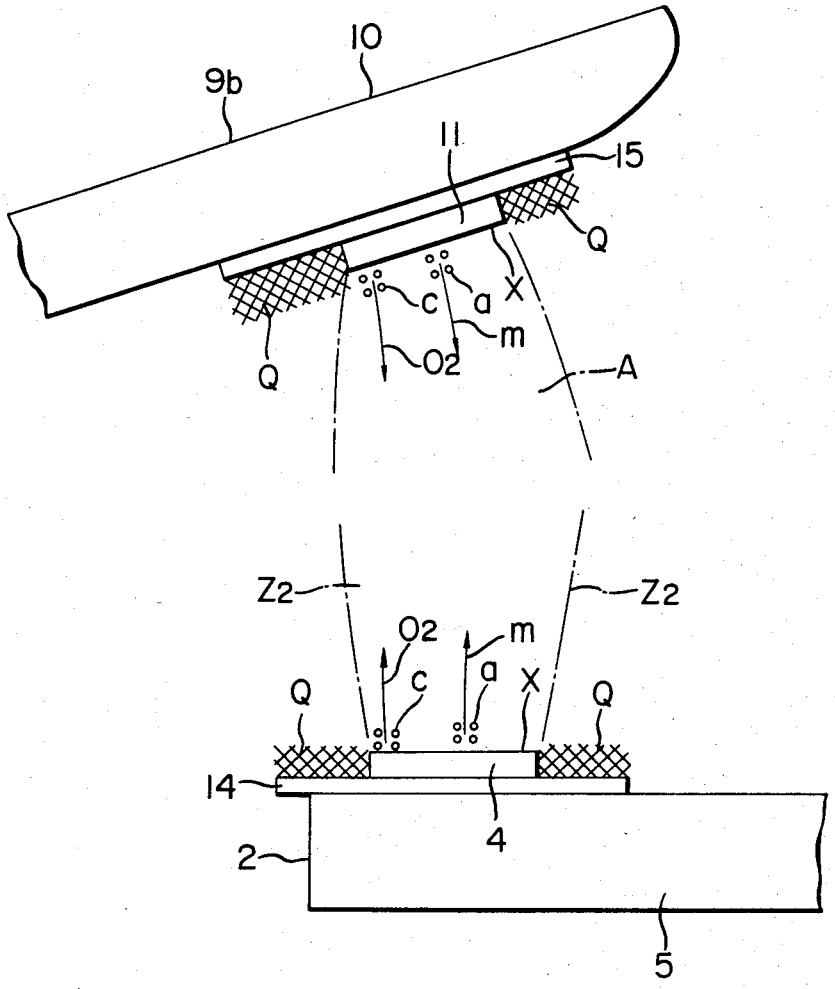
FIG. 5 is a schematic diagram illustrating the function of the arc shielding member employed for the circuit breaker of the present invention.

Operation of the above embodiment will be explained below with reference to FIG. 5, in which the same reference numerals as those of FIGS. 1 to 4*b* denote the corresponding portions. Z2 denotes the contours of the arc A which is compressed by the arc shielding members 14, 15, 02 denotes flow of particles c of contact material along paths different from those of the conventional circuit breaker owing to the provision of the arc shielding members 14 and 15, and Q denotes space (hatched areas) where the pressure is increased compared with that of the conventional circuit breaker without arc shielding members, since the pressure produced by the arc A is reflected by the arc shielding members 14 and 15.

The particles of contact material between the contacts behave as described below. That is, the pressure in space Q never becomes greater than the pressure in the arcing space, but is very high compared with a circuit breaker in which no arc shielding members 14 and 15 are provided. Therefore, the relatively high pressure established in space Q by the arc shielding members 14 and 15 works to restrain the spread of the arcing space and to confine it in a narrow region. This means that the flow paths m and n of particles a and c emitted from the opposing surfaces X are confined in the arcing space. Therefore, the particles of contact material emitted from the opposing surfaces X are effectively injected into the arcing space, whereby large amounts of particles effectively injected into the arcing space absorb the energy in amounts very much greater than that absorbed in the conventional breaker. Therefore, the arcing space is markedly quenched, the arc resistivity $\rho$, i.e., the arc resistance R is greatly increased, the arcing voltage is strikingly increased, and very good current-limiting performance is obtained.

The arcing phenomenon in the circuit breaker described with reference to FIG. 5, in which an excess of current flowed relative to the rated current of the breaker, i.e., an excess of current greater than, for example, 5000 amperes flowed through the circuit breaker having a rated current of, for example, 100 amperes. However, when a current of smaller than 600 amperes flows through the circuit breaker having a rated current of 100 amperes, the circuit breaking performance at the point of current zero becomes a problem, i.e., the insulation recovery force in the arcing space at a point of current zero becomes a problem rather than the current-limiting performance which restrains the circuit current by increasing the arcing voltage. This arises for the following reasons. The breaking current If is given by the relation, $$If = V/Z$$

where

If: breaking current

V: circuit voltage

Z: circuit impedance

When a small current is flowing, however, it means that the circuit impedance is considerably greater than the arc resistance, and the current is limited very little by the arc. Therefore, the point of current zero takes place at a moment which is determined by the impedance of the circuit.

Under such a condition, if the circuit has a large impedance and a large inductance, the circuit has a high instantaneous value of voltage at the point of current zero. To break the circuit, therefore, insulation in the arcing space must be recovered for a voltage differential between the circuit voltage and the arcing voltage. When the circuit is to be broken due to a heavy current, i.e., when the circuit has a small impedance, the current is greatly limited by the arc, the point of current zero changes greatly depending upon the degree of current limitation, the point of current zero is reached when the insulation by the arc is recovered sufficiently, and the circuit is broken predominantly by the recovered insulation of the arc.

As illustrated in the foregoing, the breaking of small currents often requires more difficult breaking performance than the breaking of heavy currents. The force of insulation recovery in space is greatly affected by the quenching of heat in the arc the positive column of arc. To effectively quench the heat in the positive column, the positive column of arc is stretched for small currents, and the heat is directly absorbed by a cooling member. The arc extinguishing plates 12 mentioned earlier serve as one means to fulfill this purpose. The arc extinguishing plates 12 are usually made of a magnetic material in such a shape as to attract and stretch the arc.

Figure 6:
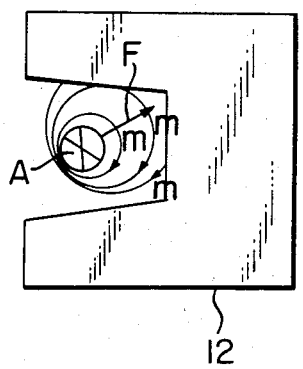
FIG. 6 is a plan view illustrating the general function of the arc extinguishing plate means.

FIG. 6 illustrates the relation between the arc and the arc extinguishing plates, wherein the arc A is taking place close to the arc extinguishing plate 12, and the current is flowing in a direction perpendicular to the plane of the drawing from the front to the back of the drawing. The magnetic field established by the arc A is indicated by symbol m. In this setup, the magnetic field around the arc is distorted by the arc extinguishing plate 12 made of magnetic material; the magnetic flux in the space close to the arc extinguishing plate 12 becomes small. Owing to the electromagnetic force, therefore, the arc is drawn in the direction indicated by F, i.e., toward the arc extinguishing plate. Thus, the arc A is stretched, the heat is abosorbed by the magnetic member, and the insulation of the positive column recovers more quickly.

Figure 7:
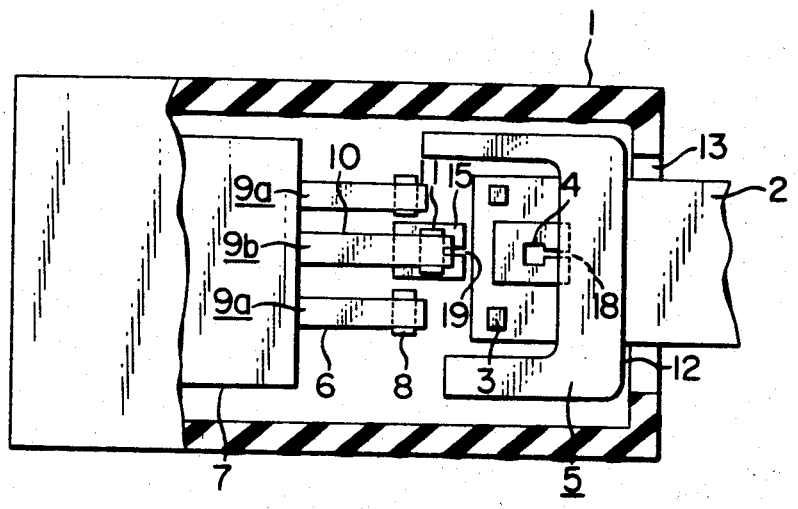
FIG. 7 is a sectional plan view of a circuit breaker according to another embodiment of the present invention.
Figure 8:
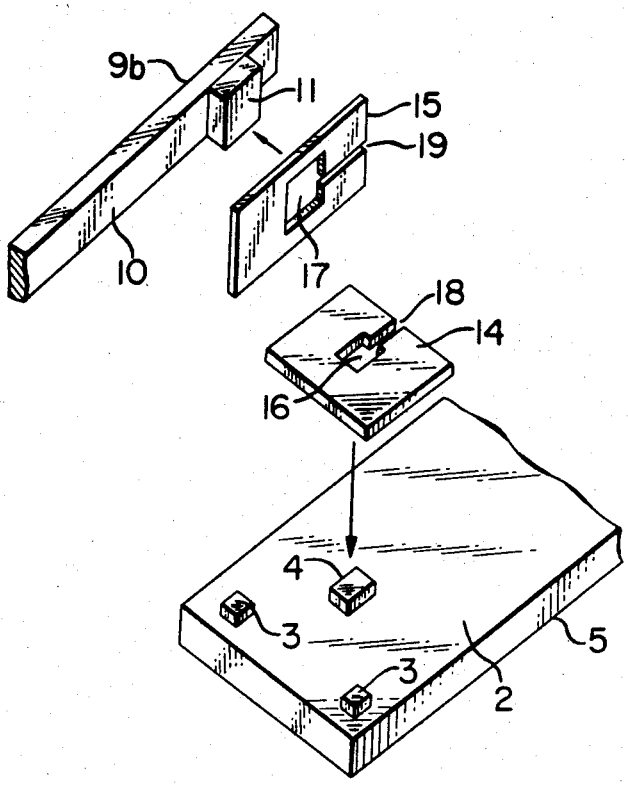
FIG. 8 is a perspective view of the arc shielding members used in the embodiment of FIG. 7.

FIGS. 7 and 8 illustrate a further embodiment, in which the feet of the arc are moved from the contacts toward the arc extinguishing plates so that it will be extinguished more effectively. The arc shielding members 14 and 15 according to this embodiment have arc guiding paths 18 and 19 consisting of grooves in the plates. The arc guiding paths 18 and 19 extend away from the contacts 4 and 11, i.e., toward the arc extinguishing plates 12 in FIG. 7. The conductors 2 and 10 are exposed in the bottom portions of the arc guiding paths 18 and 19; i.e., the arc guiding paths 18 and 19 have electric conductivity greater than the arc shielding members 14 and 15.

Figure 1B:
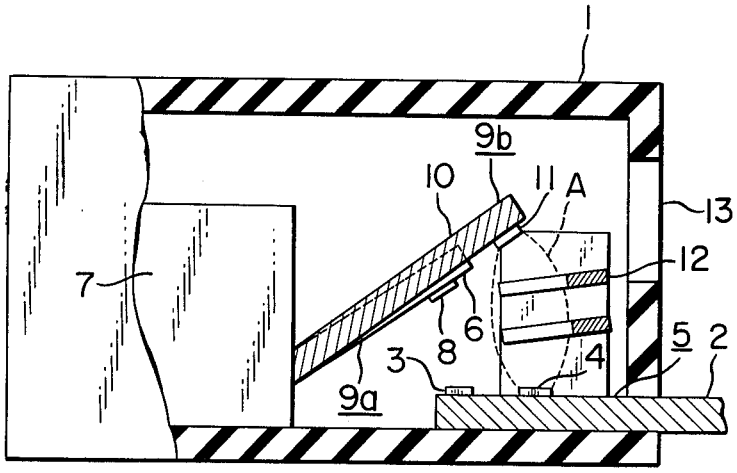
FIG. 1*b* is a sectional side view of the circuit breaker taken along the line b—b of FIG. 1*a;*
Figure 2:
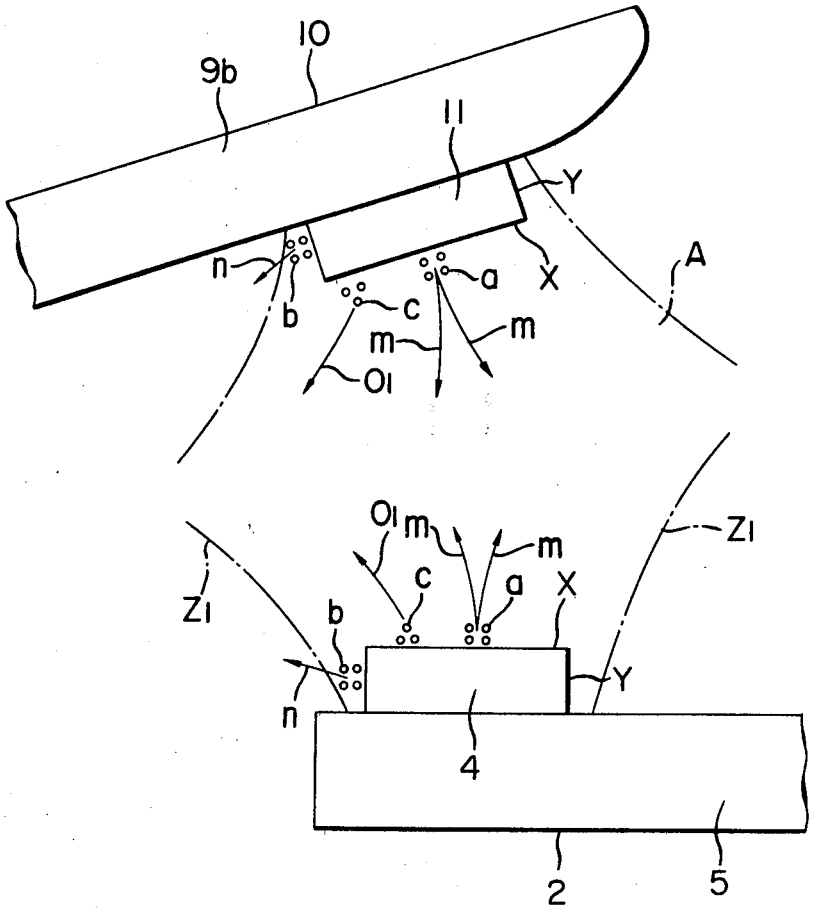
FIG. 2 is a schematic diagram illustrating the behavior of the arc established across the contacts of the circuit breaker of FIG. 1*a;*

The circuit breaker of this embodiment operates in the same manner as that of FIGS. 1*a* and 1*b*, and this operation is not described here. In this embodiment, however, since the arc extinguishing plates 12 composed of a magnetic material are located near the port 13 for releasing the arc, and since the arc shielding members 14 and 15 are provided with arc guiding paths 18 and 19, the arc moves toward the outlet port 13, and the arc stretches greatly as compared with the conventional circuit breaker. Consequently, the arc comes into direct contact with the arc extinguishing plates 12, whereby the heat is absorbed in large amounts. Therefore, the insulation recovers quickly at a point of current zero, and the circuit breaker exhibits a circuit breaking performance which is very superior to the circuit-breaking performance of the conventional circuit breakers.

Figure 9A:
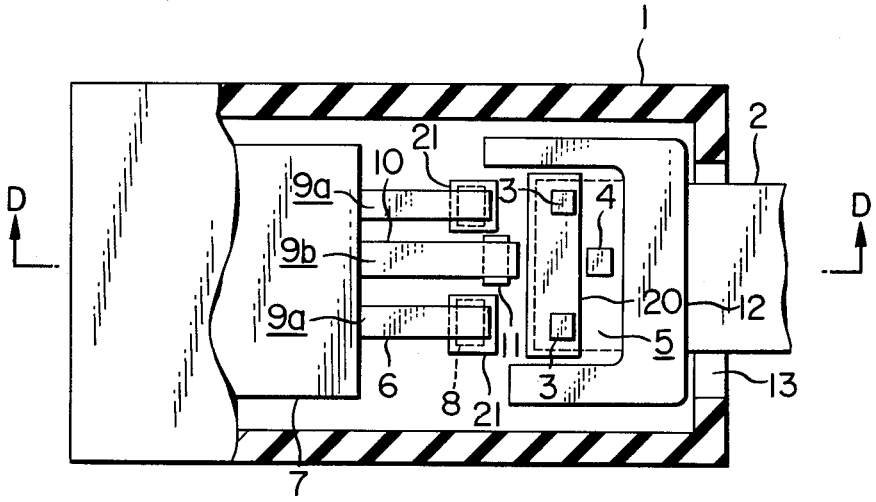
FIG. 9*a* is a sectional plan view illustrating a circuit breaker according to a further embodiment of the present invention.
Figure 9B:
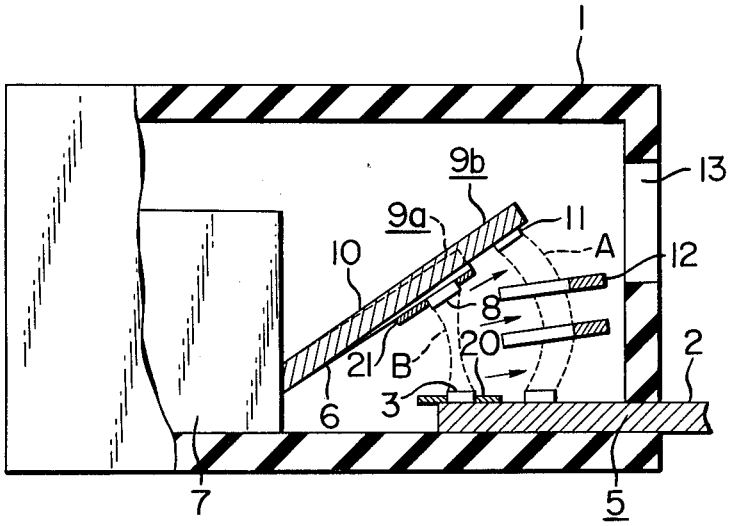
FIG. 9*b* is a sectional side view of the circuit breaker taken along the line b—b of FIG. 9*a;*

FIGS. 9*a* and 9*b* illustrate a still further embodiment of the present invention, in which arc shielding members 20 and 21 are provided on pairs of main contacts 3 and 8. The arc shielding members can be formed in the same manner as those of the embodiment of FIGS. 3*a* and 3*b*. According to this setup, even if an arc is generated secondarily across the pairs of main contacts 8 and 3 after the arcing has been established across the pair of arcing contacts 4 and 11, the secondarily generated arc can be quickly transferred to the pair of arcing contacts 4 and 11. That is, when the circuit breaker is operated, the pair of arcing contacts 4 and 11 are opened after the pairs of main contacts 3 and 8. The arc causes the environment to be ionized. The pairs of main contacts are located in the ionized atmosphere. Further, the arcing voltage across the opened pair of arcing contacts is directly applied to the pairs of main contacts. The radius of rotation of the conductors 6 for opening the pairs of main contacts is smaller than the radius of rotation of the conductor 10 for opening the pair of arcing contacts and, hence, the gap across the contacts of the conductors 6 and 2 is smaller than the gap across the contacts of the conductor 10 and conductor 2. Therefore, it can be considered that the insulation across the separated pairs of main contacts 3 and 8 is broken by the arcing voltage, and there takes place an arcing B. In the embodiment of the present invention, however, the pairs of the main contacts 3 and 8 are equipped with the arc shielding members 20 and 21. As illustrated with reference to FIG. 5, therefore, the arcing voltage across the pairs of main contacts works to inject large amounts of particles of contact material into the arcing space to quench the arcing space, whereby the arc resistivity is increased so as to be greater than that in the space across the pair of arcing contacts. Therefore, the arc across the pairs of main contacts is transferred to across the pair of arcing contacts. Therefore, the pairs of main contacts can be prevented from being worn out.

Figure 10A:
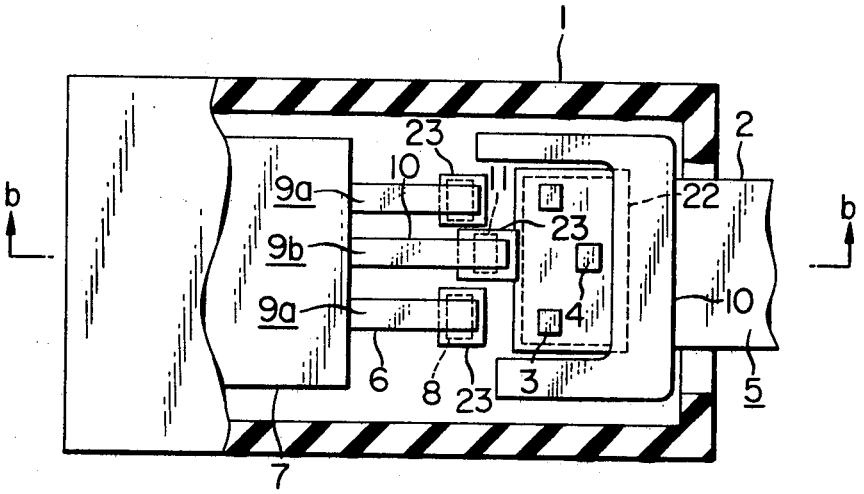
FIG. 10*a* is a sectional plan view illustrating a circuit breaker according to a still further embodiment of the present invention.
Figure 10B:
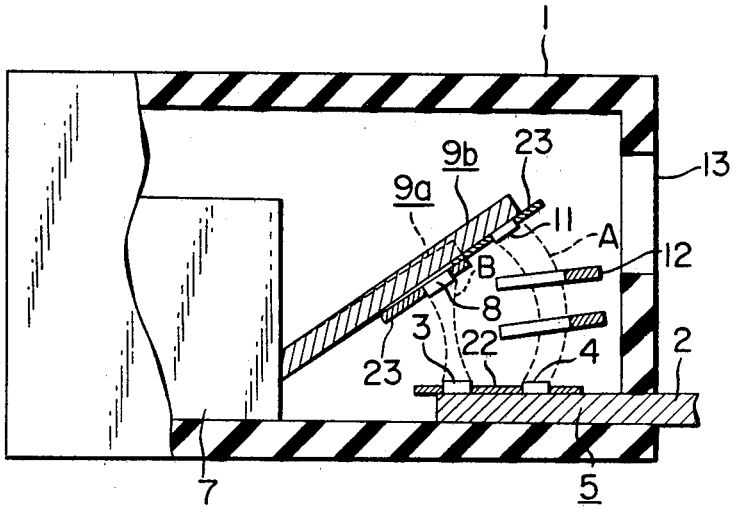
FIG. 10*b* is a sectional side view of the circuit breaker taken along the line b—b of FIG. 10*a.*

FIGS. 10*a* and 10*b* illustrate a still further embodiment of the present invention, in which arc shielding members 22 and 23 are provided for the pairs of main contacts 3 and 8 and for the pair of arcing contacts 4 and 11. The arc shielding members are formed in the same manner as the embodiment of FIGS. 3*a*, 3*b*. Therefore, not only when the arc is established across the pair of arcing contacts 4 and 11 but also when the arc is established across the pair of arcing contacts 4 and 11 and across the pairs of main contacts 3 and 8, the arc can be squeezed by the functions of the arc shielding members in the manner described with reference to FIG. 5, and the arcing voltage can be raised to effectively limit the flow of electric current.

In this embodiment, the arc shielding members are provided for both the pair of arcing contacts and the main contact pairs to effectively extinguish the arc. Therefore, there is no need to open the main contact pairs and the arcing contact pair in a predetermined order: the contacts may be opened simultaneously so that the arc shielding members exhibit the same effects.

In the circuit breakers of the embodiments of FIGS. 9*a*, 9*b* and 10*a*, 10*b*, it is, of course, possible to provide arc guiding paths in the arc shielding members in the same manner as in the embodiment of FIG. 7.

What is claimed is:

1. A circuit breaker comprising:

at least one pair of current carrying contactors, each contactor consisting of a conductor means and a contact on said conductor means, one of the contactors being movable away from or toward the other to move the contacts away from each other or bring them into contact to open or close an electric circuit;

first arc shields having a resistivity greater than that of the conductors of said current carrying contactors and mounted on said contactors surrounding the periphery of said contacts for confining the arc produced between said contacts when the arc current carrying contactors is moved away from the other to separate said contacts;

a pair of arcing contactors connected in parallel with said pair of current carrying contactors and each consisting of a conductor means and an arcing contact on said conductor means, and means for moving one of said arcing contactors away from the other at time lagging the time of moving the one current carrying contactor away from the other for opening the circuit;

second arc shields having a resistivity greater than that of the conductors of said arcing contactors and mounted on said arcing contactors surrounding the periphery of said contacts thereon for confining the arc produced between said contacts when said arcing contacts are moved away from each other to separate said contacts;

an arc extinguishing means for extinguishing an arc produced between said contacts and provided in the vicinity of said contactors and in a direction away from said contactors toward which the arc formed between the contacts tends to expand; and an arc guiding path provided along the second arc shield on at least one of said arcing contactors and which has a resistivity smaller than that of the resistivity of said arc shields and which has one end thereof adjacent the contact on said arcing contactor and which has the other end thereof extending toward said arc extinguishing means.

2. A circuit breaker as claimed in claim 1 in which said second arc shield has a slit therein which extends from said contact to said arc extinguishing means, and said arc guiding path is constituted by the surface of the conductor exposed through said slit.

3. A circuit breaker as claimed in claim 1 in which arc guiding paths are provided along said second arc shields on both the arcing contactors.

4. A circuit breaker as claimed in claim 3 in which said second arc shields both have a slit therein which extends from said contacts to said arc extinguishing means, and said arc guiding paths are constituted by the surface of the conductor exposed through said slits.

5. A circuit breaker as claimed in claim 1 further comprising a further arc guiding path provided along the first arc shield on at least one of said current carrying conductors of the pair and which has a resistivity smaller than that of the resistivity of said first arc shields and which has one end thereof adjacent the contact on said current carrying contactor and which has the other end thereof extending toward said arc extinguishing means.

6. A circuit breaker as claimed in claim 5 in which said first arc shield has a slit therein which extends from said contact to said arc extinguishing means, and said arc guiding path is constituted by the surface of the conductor exposed through said slit.

7. A circuit breaker as claimed in claim 5 in which said arc guiding paths are provided along said first arc shields on all the current carrying contactors.

8. A circuit breaker as claimed in claim 7 in which said first arc shields all have a slit therein which extends from said contacts to said arc extinguishing means, and said arc guiding paths are constituted by the surface of the conductor exposed through said slits.

* * * * *